US006460595B1

(12) United States Patent
Benz et al.

(10) Patent No.: US 6,460,595 B1
(45) Date of Patent: Oct. 8, 2002

(54) NUCLEATED CASTING SYSTEMS AND METHODS COMPRISING THE ADDITION OF POWDERS TO A CASTING

(75) Inventors: Mark Gilbert Benz, Burnt Hills; William Thomas Carter, Jr., Galway; Robert John Zabala, Schenectady; Bruce Alan Knudsen, Amsterdam, all of NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/511,529

(22) Filed: Feb. 23, 2000

Related U.S. Application Data

(60) Provisional application No. 60/121,187, filed on Feb. 23, 1999.

(51) Int. Cl.[7] ..... B22D 23/00; B22D 27/02

(52) U.S. Cl. ..... 164/46; 164/97; 164/497; 164/509

(58) Field of Search ..... 164/46, 97; 29/527.5, 29/527.2

(56) References Cited

U.S. PATENT DOCUMENTS 4,069,045 A * 1/1978 Lundgren ..... 75/251
4,588,019 A * 5/1986 Wentzell ..... 164/470
5,160,532 A * 11/1992 Benz et al. ..... 75/10.24
5,310,165 A 5/1994 Benz et al.
5,325,906 A 7/1994 Benz et al.
5,348,566 A 9/1994 Sawyer et al.
5,381,847 A * 1/1995 Ashok et al. ..... 164/46
5,472,177 A 12/1995 Benz et al.
5,480,097 A 1/1996 Carter, Jr. et al.
5,494,197 A * 2/1996 Grieves ..... 222/181.2
5,613,624 A * 3/1997 Grzybowski et al. ..... 222/161
5,649,993 A 7/1997 Carter, Jr. et al.
5,683,653 A 11/1997 Benz et al.
5,769,151 A 6/1998 Carter, Jr. et al.
5,803,152 A * 9/1998 Dolman et al. ..... 164/57.1
5,809,057 A 9/1998 Benz et al.
5,810,066 A 9/1998 Knudsen et al.

* cited by examiner

*Primary Examiner*—M. Alexandra Elve
*Assistant Examiner*—Kevin McHenry
(74) *Attorney, Agent, or Firm*—Robert P. Santandrea; Noreen C. Johnson

(57) ABSTRACT

Nucleated casting systems and methods comprise the addition of powders into a liquidus portion of the casting. The casting system forms a casting comprising a liquidus portion that receives the refined liquid metal and a solidified portion, the casting further comprising a fine-grain, homogeneous microstructure that is essentially oxide- and sulfide-free and segregation defect free. The casting system comprises a source of refined liquid metal, the refined liquid metal having oxides and sulfides refined out of the metal; a solid metal particle addition system that adds solid metal particles to a surface of the liquidus portion of the casting; and a nucleated casting system for forming the casting. The solid metal particle addition system adds solid metal particles that serve as nucleation centers during solidification of the casting.

49 Claims, 7 Drawing Sheets

NUCLEATED CASTING SYSTEMS AND METHODS COMPRISING THE ADDITION OF POWDERS TO A CASTING

This application claims priority of a Provisional Application entitled "Clean Metal Nucleated Casting Systems and Methods" by Carter et al., U.S. Ser. No. 60/121,187, which was filed on Feb. 23, 1999.

BACKGROUND OF THE INVENTION

The invention relates to nucleated casting systems and associated methods for forming the casting. In particular, the invention relates to nucleated cast systems and methods that comprise the addition of powders to a casting.

Metals, such as iron- (Fe), nickel- (Ni), titanium- (Ti), and cobalt- (Co) based alloys, are often used in turbine component applications, in which fine-grained microstructures, homogeneity, and essentially defect-free compositions are desired. Problems in superalloy castings and ingots are undesirable as the costs associated with superalloy formation are high, and results of these problems, especially in ingots formed into turbine components are undesirable. Conventional systems for producing castings have attempted to reduce the amount of impurities, contaminants, and other constituents, which may produce undesirable consequences in a casting made from the casting.

Casting to form articles (hereinafter "castings") may include at least a step of electroslag refining (ESR) (such as disclosed in U.S. Pat. Nos. 5,160,532; 5,310,165; 5,325,906; 5,332,197; 5,348,566; 5,366,206; 5,472,177; 5,480,097; 5,769,151; 5,809,057; and 5,810,066, all of which are assigned to the Assignee of the instant invention). Other metallurgical methods, such as, but not limited to, refining and mechanical working, may be combined with ESR to further refine and form the casting to reduce the amount of impurities, contaminants, and other constituents. While the metal produced by such a sequence is useful and the metal product itself is valuable, the processing is quite expensive and time-consuming. Further, the processing and refining of relatively large bodies of metal, such as superalloys, is often accompanied by problems, for example problems in achieving homogeneous, defect-free structure.

One such problem that often arises in superalloy casting comprises controlling the grain size and other microstructure of the refined metals during nucleation and solidification from a liquid to a solid. Further, problems of alloy or ingredient segregation also occur as processing is performed on large bodies of metal. Problems may arise during some electroslag refining processing operations. For example, a conventional electroslag refining method typically uses a refining vessel that contains a slag refining layer floating on a layer of molten refined metal. An ingot of unrefined metal is generally used as a consumable electrode and is lowered into the vessel to make contact with the molten electroslag layer. An electric current is passed through the slag layer to the ingot and causes surface melting at the interface between the ingot and the slag layer. As the ingot is melted, oxide inclusions or impurities are exposed to the slag and removed at the contact point between the ingot and the slag. Droplets of refined metal are formed, and these droplets pass through the slag and are collected in a pool of molten refined metal beneath the slag. The electroslag refining apparatus may be dependent on a relationship between the individual method parameters, such as, but not limited to, an intensity of the refined current, specific heat input, and melting rate. This relationship involves undesirable interdependence between the rate of electroslag refining of the metal, metal ingot temperature, and rate at which the refined molten metal is cooled, all of which may result in poor metallurgical structure in the resultant casting.

Another problem that may be associated with conventional electroslag refining processing comprises the formation of a relatively deep metal pool in an electroslag crucible. A deep melt pool may cause a varied degree of ingredient macrosegregation in the metal that leads to a less desirable microstructure, such as a microstructure that is not a fine-grained microstructure, or segregation of the elemental species so as to form an inhomogeneous structure. A subsequent operation has been proposed in combination with the electroslag refining method to overcome this deep melt pool problem. This subsequent processing may be vacuum arc remelting (VAR). Vacuum arc remelting is initiated when an ingot is processed by vacuum arc steps to produce a relatively shallow melt pool, whereby an improved microstructure, which may also possess a lower hydrogen content, is produced. Following the vacuum arc refining method, the resulting ingot is then mechanically worked to yield a metal stock having a desirable fine-grained microstructure. Such mechanical working may involve a combination of steps of forging and drawing. This thermomechanical processing requires large, expensive equipment, as well as costly amounts of energy input.

An attempt to provide a desirable casting microstructure has been proposed in U.S. Pat. No. 5,381,847, in which a vertical casting method attempts to control grain microstructure by controlling dendritic growth. The method may be able to provide a useable microstructure for some casting applications. However, the vertical casting method does not control the source metal contents, including but not limited to impurities, oxides, and other undesirable constituents. Further, the vertical casting operation forms a relatively deep liquidus portion in the mold, in which the liquidus portion is slow to solidify due to slow metal nuclei formation therein. The slow nuclei formation slows the casting operation, and may also may adversely impact a casting's microstructure and characteristics.

Therefore, a need exists to provide metal casting methods and systems that enhance nuclei formation, produce a casting with a relatively homogeneous, fine-grained microstructure, and that can be supplied with a clean metal source. Further, a need exists to provide a methods and systems that produce a casting with a relatively homogeneous, fine-grained microstructure. Further, a need exists to provide methods and systems that produce a casting that is essentially free of oxides, for turbine component applications.

SUMMARY OF THE INVENTION

An aspect of the invention sets forth nucleated casting systems and methods that comprise the addition of powders into a liquidus portion of the casting. The casting system forms a casting comprising a liquidus portion that receives the refined liquid metal and a solidified portion, the casting further comprising a fine-grain, homogeneous microstructure that is essentially oxide- and sulfide-free and metal, the refined liquid metal having oxides and sulfides refined out of the metal; a solid metal particle addition system that adds solid metal particles to a surface of the liquidus portion of the casting; and a nucleated casting system for forming the casting. The solid metal particle addition system adds solid metal particles that serve as nucleation centers during solidification of the casting.

A further aspect of the invention comprises a casting method with solid metal particle addition for forming a casting. The casting comprises a liquidus portion that receives the refined liquid metal and a solidified portion. The casting further comprises a fine-grain, homogeneous microstructure that is essentially oxide- and sulfide-free and segregation defect free. The casting method comprises providing a source of refined liquid metal, supplying the refined liquid metal to a mold; adding solid metal particles to the casting; forming a casting by nucleated casting, the casting comprising a liquidus portion and a solidified portion. The solid metal particles serve as nucleation centers during solidification.

These and other aspects, advantages and salient features of the invention will become apparent from the following detailed description, which, when taken in conjunction with the annexed drawings, where like parts are designated by like reference characters throughout the drawings, disclose embodiments of the invention.

DESCRIPTION OF THE INVENTION

Figure 1:
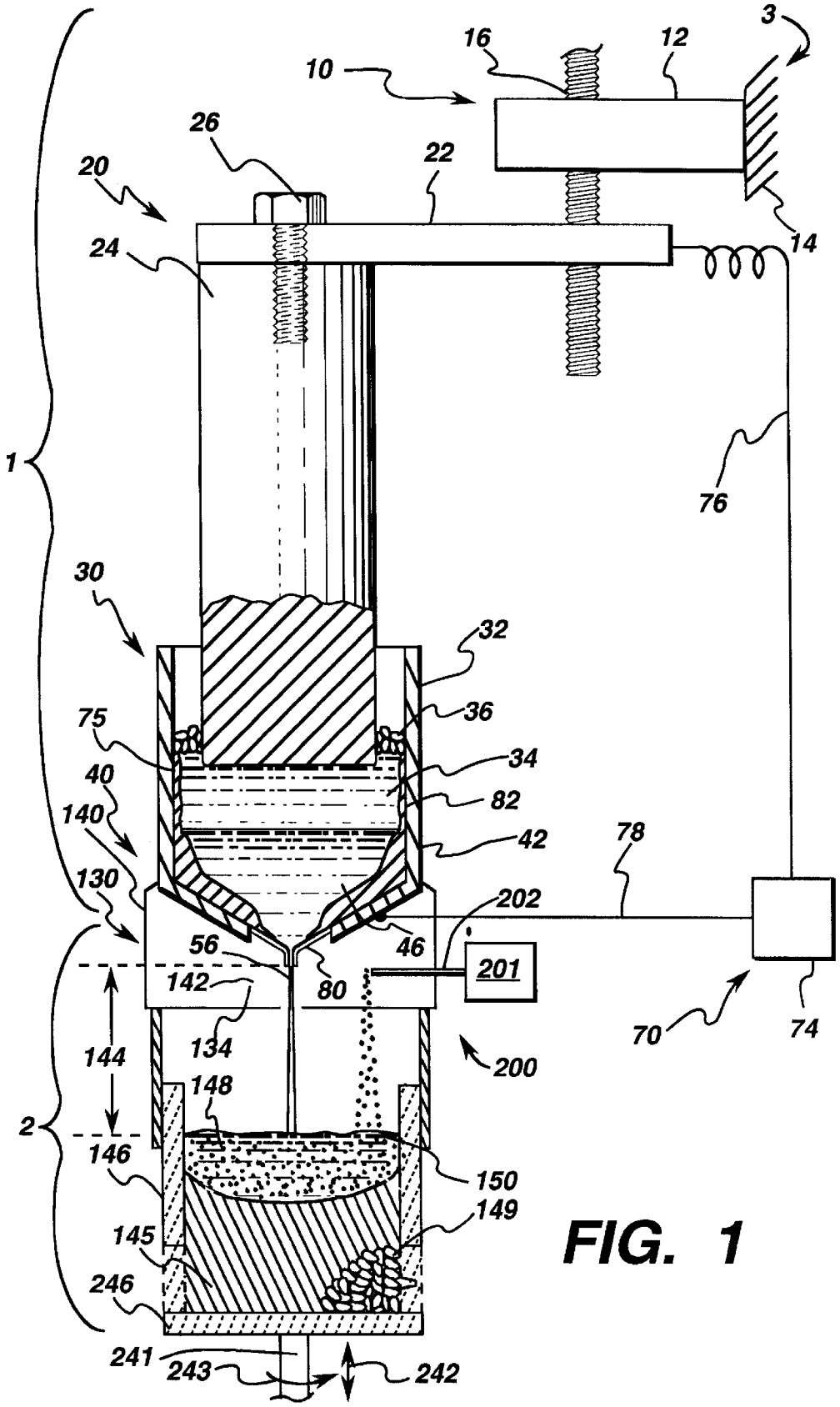
FIG. 1 is a schematic illustration of a casting system with powder addition, as embodied by the invention.

A casting system and method, as embodied by the invention, comprise a source of clean metal that can be provided as a liquid metal stream for a nucleated casting system (also known as a "vertical casting system"). The casting system, as embodied by the invention, further provides for the addition of solid metal particles into a liquidus portion of the casting. The solid metal particles can comprise, but are not limited to, metal powder(hereinafter "solid metal particles"). The solid metal particles enter the liquidus portion and are generally distributed over a top surface of the liquidus portion, for example distributed over an entire surface of the liquidus portion. The solid metal particles serve as nuclei for the solidification of the liquid metal during solidification.

The casting method comprises steps of forming a source of clean liquid metal, for example from an electroslag refining system, delivering or supplying the clean metal to a nucleated casting system, adding solid metal particles to the liquidus portion, and producing the casting, such as but not limited to, a casting, ingot, or preform, with an essentially oxide free and impurity free material, while adding solid metal particles to a liquidus portion of the casting. The term "essentially free" means that any constituents in the material do not adversely influence the material, for example its strength and related characteristics. Further, the casting method produces castings in which segregation of defects has been reduced, especially when compared to castings produced by conventional melting methods, such as described above. The description of the invention will describe a casting formed by the casting methods and systems, however, this description is merely exemplary and not intended to limit the invention in any manner.

The clean-liquid metal source can comprise an electroslag refining apparatus that provides a clean liquid metal, because of the electroslag refining steps. For example, the electroslag refining apparatus comprises an electroslag refining system in cooperation with a cold-induction guide (CIG), for example as set forth in the above-mentioned patents to the Assignee of the instant invention. The nucleated casting system can comprise a system that permits molten metal to pass through a cooling zone, which is formed with a length sufficient to allow up to about 30 volume percent (on average) of each of the molten metal to solidify. The molten metal is then received by a mold and solidification of the molten metal is completed in the mold. The molten metal retains liquid characteristics and readily flow within the mold, when less than about 30 volume percent is solid.

The casting methods and systems, as embodied by the invention, can produce a casting, which includes a homogeneous, fine-grained microstructure, for many metals and alloys, including but not limited to nickel- (Ni) and cobalt- (Co) based superalloys, iron- (Fe), titanium- (Ti), alloys, which are often used in turbine component applications. The castings formed by the casting methods and systems can be converted into a final casting, a billet, or directly forged with reduced processing and heat treatment steps, due to their homogeneous, fine-grained microstructure. Accordingly, the casting methods and systems can be used to produce high quality forgings that can be used in many applications, such as but not limited to rotating equipment applications, such as, but not limited to, disks, rotors, blades, vanes, wheel, buckets, rings, shafts, wheels, and other such elements, and other turbine component applications. The description of the invention will refer to turbine components formed from castings, however, this is merely exemplary of the applications within the scope of the invention.

Figure 2:
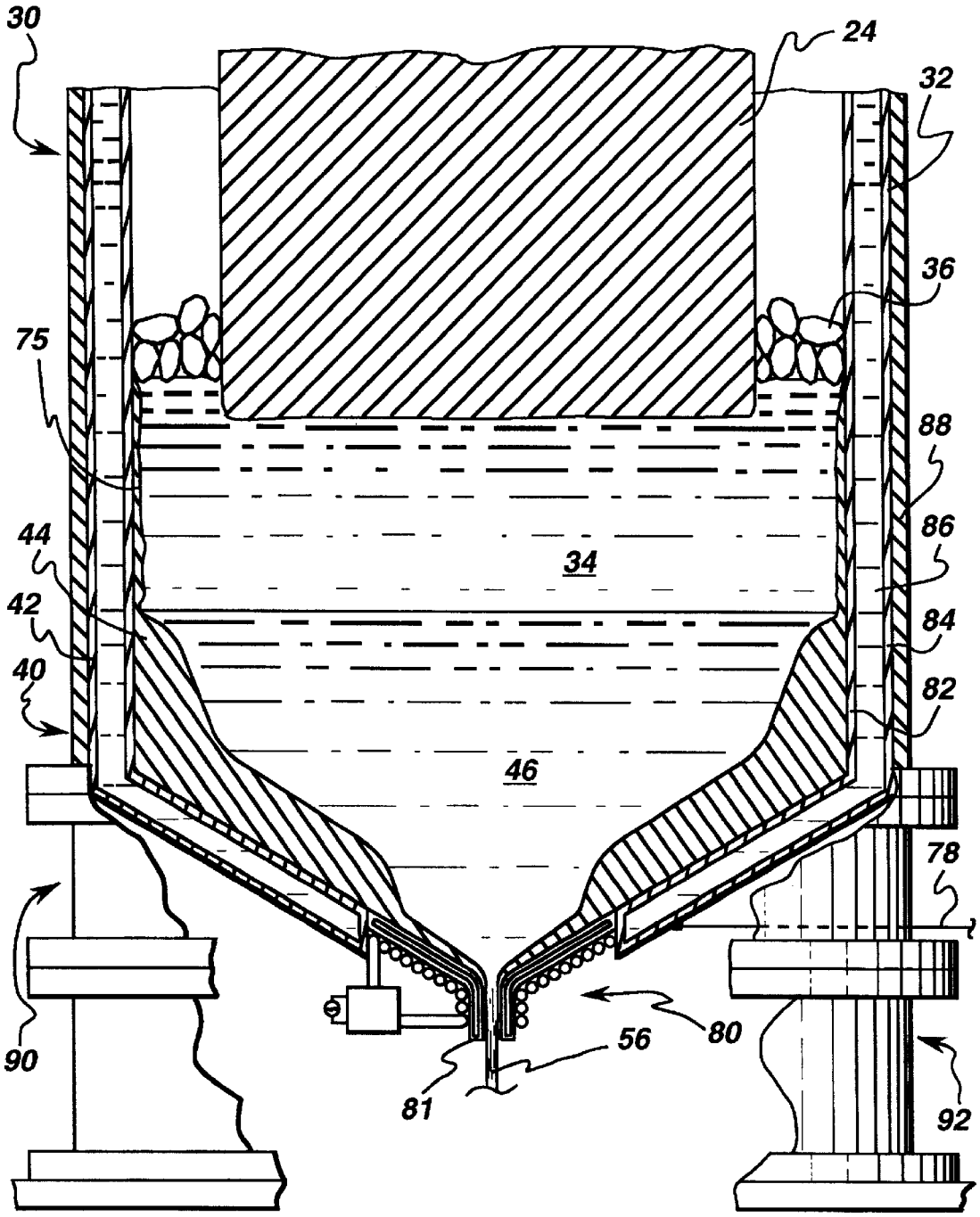
FIG. 2 is a partial schematic, vertical sectional illustration of the casting system of FIG. 1 that illustrates details of an electroslag refining system portion of the casting system.
Figure 3:
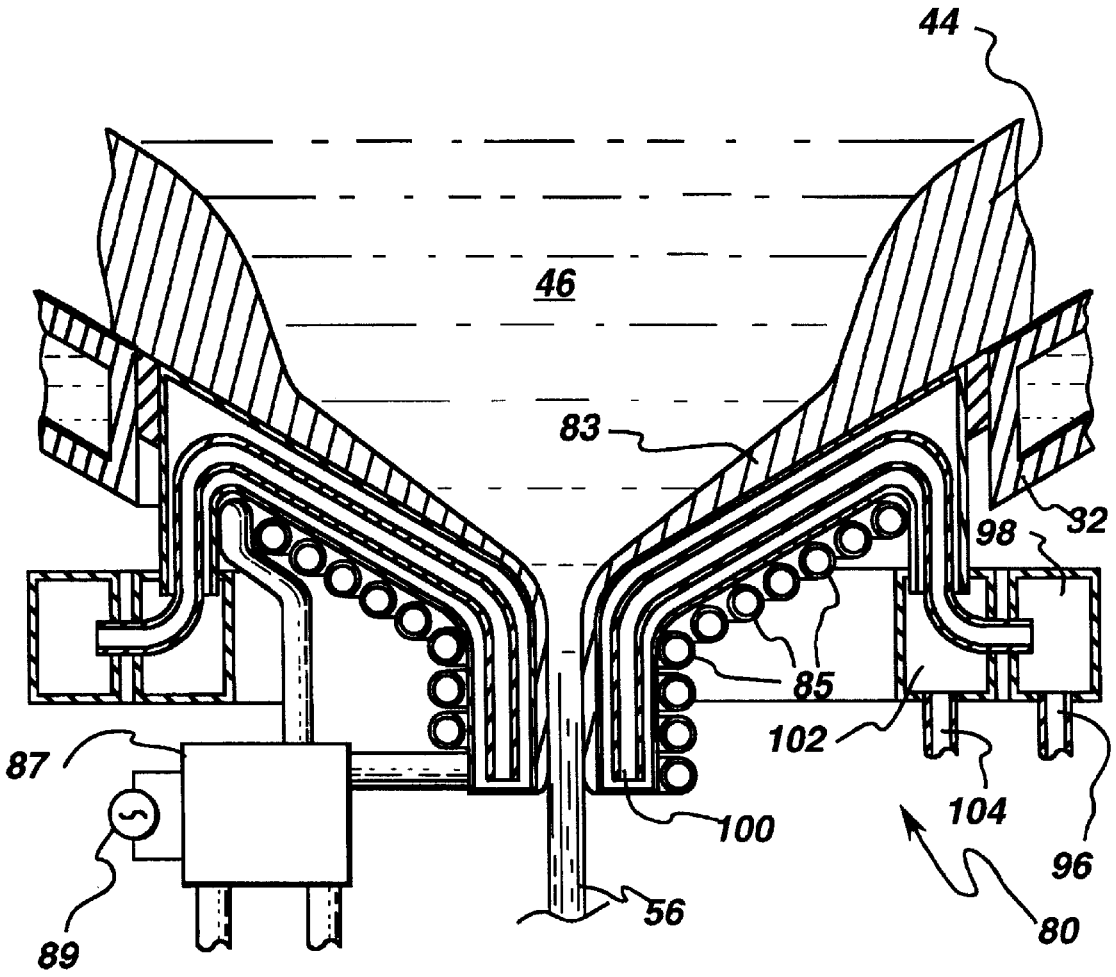
FIG. 3 is a partial schematic, vertical section illustration in detail of the electroslag refining system portion.
Figure 4:
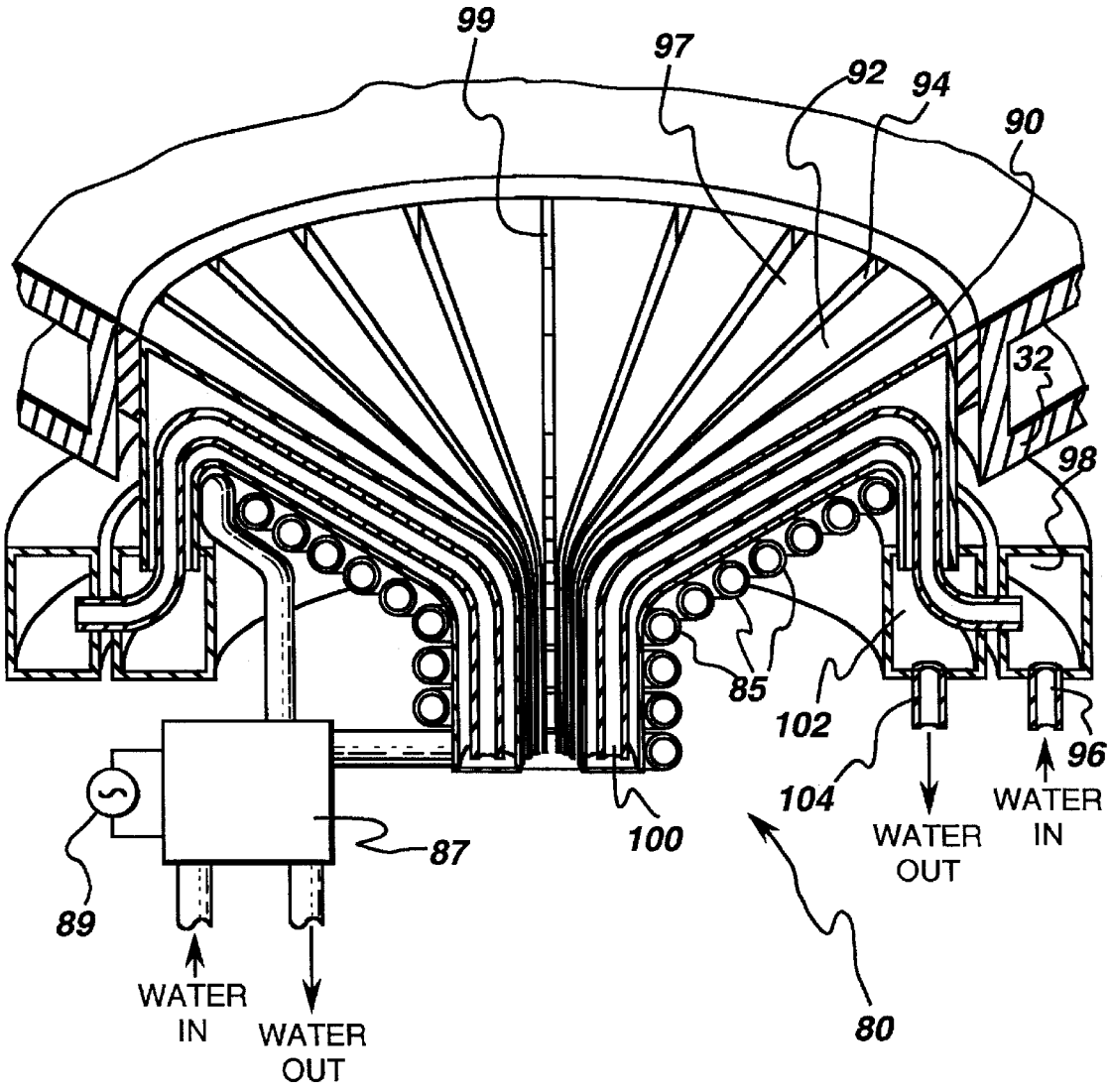
Prior Art FIG. 4
FIG. 4 is a partial schematic, part sectional illustration of the electroslag refining system of the casting system for producing a casting.
Figure 5:
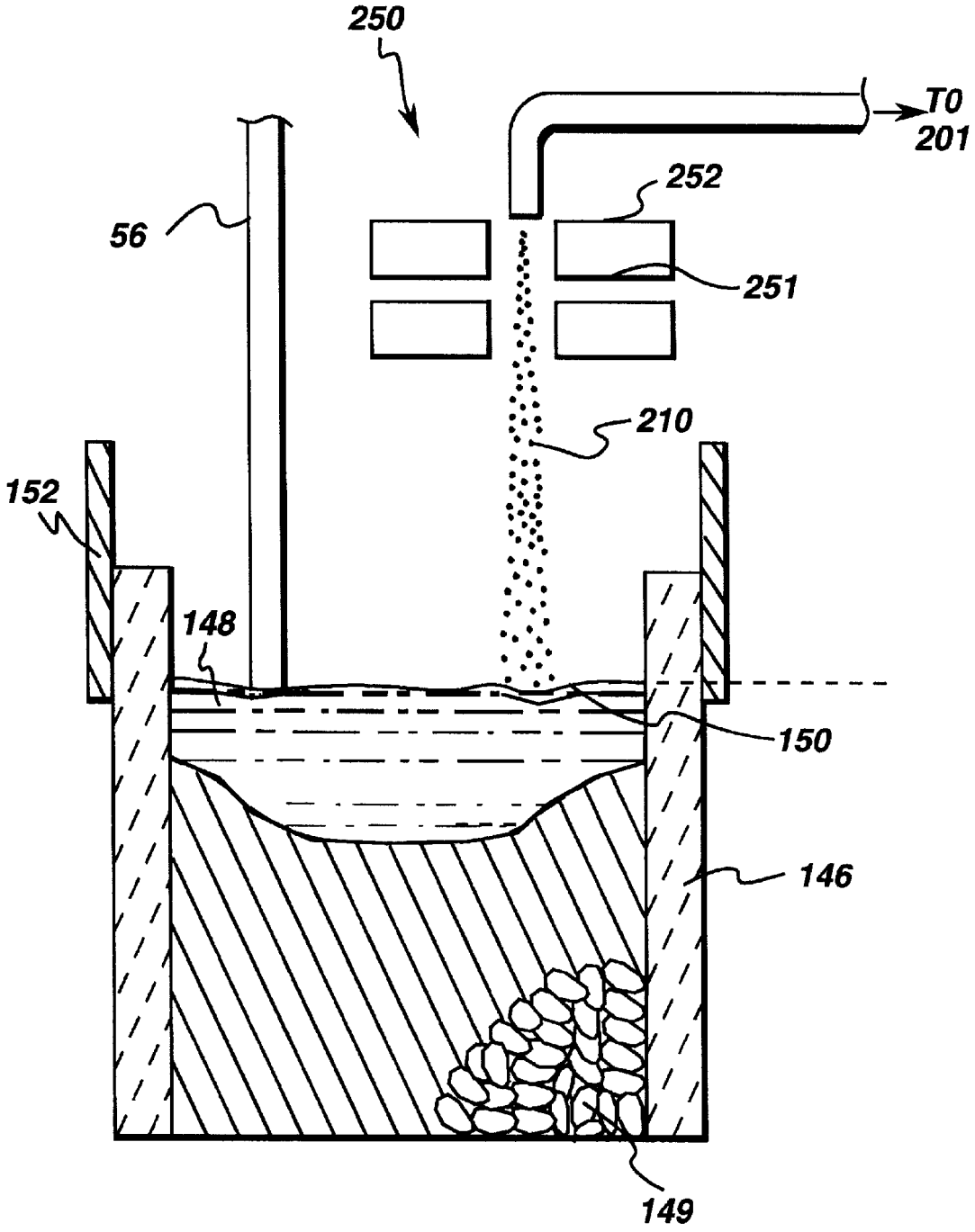
FIG. 5 is an exemplary partial schematic, part sectional illustration of a solid metal particle addition system for a casting system, as embodied by the invention.
Figure 6:
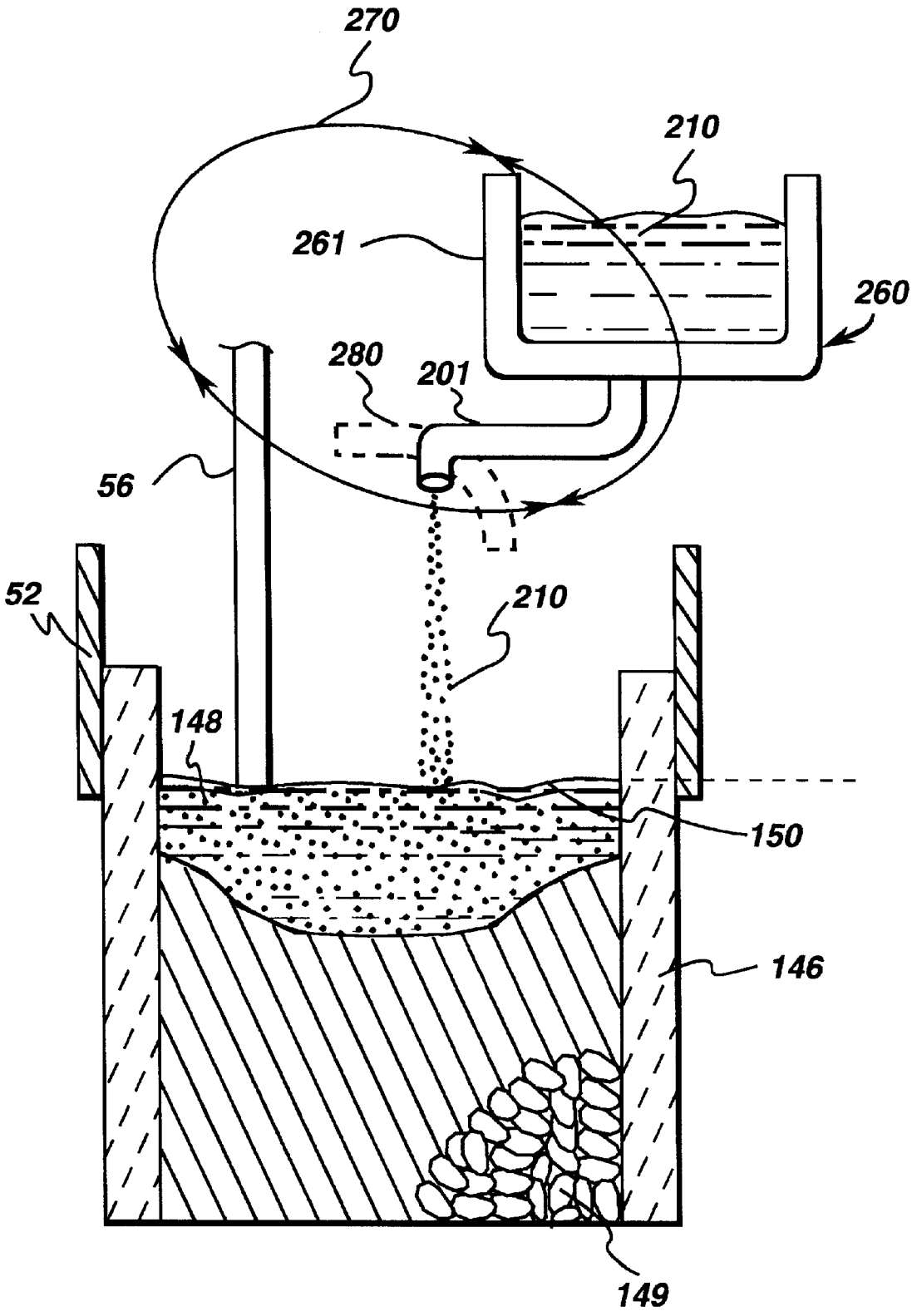
FIG. 6 is another exemplary partial schematic, part sectional illustration of a solid metal particle addition system for a casting system, as embodied by the invention.

Referring to the accompanying drawings, FIG. 1 illustrates a semi-schematic, part-sectional, elevational view of the casting system 3 with solid metal particle addition. FIGS. 2–4 illustrate details of casting system features illustrated in FIG. 1, while FIGS. 5 and 6 illustrate features of the solid metal particle addition system, as embodied by the invention. The electroslag refining system 1 will be initially described, followed by a description of the casting system 3, and then by a description of solid metal particle addition systems to facilitate the understanding of the invention.

In FIG. 1, the clean metal for the casting system 3 and its associated casting methods is provided by an electroslag refining system 1. The clean metal is fed to a nucleated casting system 2. The electroslag refining system 1 and nucleated casting system 2 cooperate to form a casting system 3 comprising the addition of solid metal particles, which forms a casting. The electroslag refining system 1 introduces a consumable electrode 24 of metal to be refined directly into an electroslag refining system 1, and refines the consumable electrode 24 to produce a clean, refined metal melt 46 (hereafter "clean metal"). The source of metal for the electroslag refining system 1 as a consumable electrode 24 is merely exemplary, and the scope of the invention comprises, but is not limited to, the source metal comprising an ingot, melt of metal, powder metal, and combinations thereof. The description of the invention will refer to a consumable electrode, however this is merely exemplary and is not intended to limit the invention in any manner. The clean metal 46 is received and retained within a cold hearth structure 40 that is mounted below the electroslag refining apparatus 1. The clean metal 46 is dispensed from the cold hearth structure 40 through a cold finger orifice structure 80 that is mounted and disposed below the cold hearth structure 40.

The electroslag refining system 1 can provide essentially steady state operation in supplying clean metal 46 if the rate of electroslag refining of metal and rate of delivery of refined metal to a cold hearth structure 40 approximates the rate at which molten metal 46 is drained from the cold hearth structure 40 through an orifice 81 of the cold finger orifice structure 80. Thus, the casting method can operate continuously for an extended period of time and, accordingly, can method a large bulk of metal. Alternatively, the casting method can be operated intermittently by intermittent operation of one or more of the features of the casting system 3.

Once the clean metal 46 exits the electroslag refining system 1 through the cold finger orifice structure 80 as stream 56, it enters into the nucleated casting system 2 to form a casting 145. The casting 145 can be processed to produce a relatively large casting of refined metal. Alternatively, the casting 145 may be processed through to produce smaller castings, ingots, articles, or formed into continuous cast castings. The casting method, as embodied by the invention, effectively eliminates many of the processing operations, such as those described above that, until now, have been necessary in order to produce a metal casting having a desired set of material characteristics and properties.

FIG. 1 generally illustrates a solid metal particle addition system 200 that introduces solid metal particles 210 into the liquidus portion 148 of a casting 145. The solid metal particle addition system 200 comprises a source 201 of solid metal particles, a conduit 202 that can feed metal from the source 201 to a dispersion system 204 to form solid metal particles. The source 201 of the solid metal particles may comprise any suitable source that can add solid metal particles 210 to the liquidus portion 148. For example, and in no way limiting of the invention, the solid metal particle source 201 may include an atomizing system that produces solid metal powder, a receptacle comprising solid metal particles that can be added into the liquidus portion 148 by an appropriate device, and other such solid metal particle addition systems. The dispersion system 204 permits the solid metal particles 210 to exit the solid metal particle addition system 200 and be fed to the liquidus portion 148 of the casting 145, as described hereinafter. The solid metal particle addition system 200 will be described in further detail hereinafter, with reference to FIGS. 5 and 6.

In FIG. 1, a vertical motion control apparatus 10 is schematically illustrated. The vertical motion control apparatus 10 comprises a box 12 mounted to a vertical support 14 that includes a motive device (not illustrated), such as but not limited to a motor or other mechanism. The motive device is adapted to impart rotary motion to a screw member 16. An ingot support structure 20 comprises a member, such as but not limited to a member 22, that is threadedly engaged at one end to the screw member 16. The member 22 supports the consumable electrode 24 at its other end by an appropriate connection, such as, but not limited to, a bolt 26.

An electroslag refining structure 30 comprises a reservoir 32 that is cooled by an appropriate coolant, such as, but not limited to, water. The reservoir 32 comprises a molten slag 34, in which an excess of the slag 34 is illustrated as the solid slag granules 36. The slag composition used in the casting method will vary with the metal being processed. A slag skull 75 may be formed along inside surfaces of an inner wall 82 of reservoir 32, due to the cooling influence of the coolant flowing against the outside of inner wall 82, as described hereinafter.

A cold hearth structure 40 (FIGS. 1–3) is mounted below the electroslag refining structure 30. The cold hearth structure 40 comprises a hearth 42, which is cooled by an appropriate coolant, such as water. The hearth 42 contains a skull 44 of solidified refined metal and a body 46 of refined liquid metal. The reservoir 32 may be formed integrally with the hearth 42. Alternatively, the reservoir 32 and hearth 42 may be formed as separate units, which are connected to form the electroslag refining system 1. A bottom orifice 81 of the electroslag refining system 1 is provided in the cold finger orifice structure 80, which is described with reference to FIGS. 3 and 4. A clean metal 46, which is refined by the electroslag refining system 1 so as to be essentially free of oxides, sulfides, and other impurities, can traverse the electroslag refining system 1 and flow out of the orifice 81 of the cold finger orifice structure 80.

A power supply structure 70 can supply electric refining current to the electroslag refining system 1. The power supply structure 70 can comprise an electric power supply and control mechanism 74. An electrical conductor 76 that is able to carry current to the member 22 and, in turn, carry current to the consumable electrode 24 connects the power supply structure 70 to the member 22. A conductor 78 is connected to the reservoir 32 to complete a circuit for the power supply structure 70 of the electroslag refining system 1.

FIG. 2 is a detailed part-sectional illustration of the electroslag refining structure 30 and the cold hearth structure 40 in which the electroslag refining structure 30 defines an upper portion of the reservoir 32 and the cold hearth structure 40 defines a lower portion 42 of the reservoir 32. The reservoir 32 generally comprises a double-walled reservoir, which includes an inner wall 82 and outer wall 84. A coolant 86, such as but not limited to water, is provided between the inner wall 82 and outer wall 84. The coolant 86 can flow to and through a flow channel, which is defined between the inner wall 82 and outer wall 84 from a supply 98 (FIG. 3) and through conventional inlets and outlets (not illustrated in the figures). The cooling water 86 that cools the wall 82 of the cold hearth structure 40 provides cooling to the electroslag refining structure 30 and the cold hearth structure 40 to cause the skull 44 to form on the inner surface of the cold hearth structure 40. The coolant 86 is not essential for operation of the electroslag refining system 1, casting system 3, or electroslag refining structure 30. Cooling may insure that the liquid metal 46 does not contact and attack the inner wall 82, which may cause some dissolution from the wall 82 and contaminate the liquid metal 46.

In FIG. 2, the cold hearth structure 40 also comprises an outer wall 88, which may include flanged tubular sections, 90 and 92. Two flanged tubular sections 90 and 92 are illustrated in the bottom portion of FIG. 2. The outer wall 88 cooperates with the nucleated casting system 2 to form a controlled atmosphere environment 140, which is described hereinafter. The cold hearth structure 40 comprises a cold finger orifice structure 80 that is shown detail FIGS. 3 and 4. The cold finger orifice structure 80 is illustrated in FIG. 3 in relation to the cold hearth structure 40 and a stream 56 of liquid melt 46 that exits the cold hearth structure 40 through the cold finger orifice structure 80. The cold finger orifice structure 80 is illustrated (FIGS. 2 and 3) in structural cooperation with the solid metal skull 44 and liquid metal 46. FIG. 4 illustrates the cold finger orifice structure 80 without the liquid metal or solid metal skull, so details of the cold finger orifice structure 80 are illustrated.

The cold finger orifice structure 80 comprises the orifice 81 from which processed molten metal 46 is able to flow in the form of a stream 56. The cold finger orifice structure 80 is connected to the cold hearth structure 40 and the cold hearth structure 30. Therefore, the cold hearth structure 40 allows processed and generally impurity-free alloy to form the skulls 44 and 83 by contacting walls of the cold hearth structure 40. The skulls 44 and 83 thus act as a container for the molten metal 46. Additionally, the skull 83 (FIG. 3), which is formed at the cold finger orifice structure 80, is controllable in terms of its thickness, and is typically formed with a smaller thickness than the skull 44. The thicker skull 44 contacts the cold hearth structure 40 and the thinner skull 83 contacts the cold finger orifice structure 80, and the skulls 44 and 83 are in contact with each other to form an essentially continuous skull.

A controlled amount of heat may be provided to the skull 83 and thermally transmitted to the liquid metal body 46. The heat is provided from induction heating coils 85 that are disposed around the cold hearth structure. An induction-heating coil 85 can comprise a cooled induction-heating coil, by flow of an appropriate coolant, such as water, into it from a supply 87. Induction heating power is supplied from a power source 89, which is schematically illustrated in FIG. 3. The construction of the cold finger orifice structure 80 permits heating by induction energy to penetrate the cold finger orifice structure 80 and heat the liquid metal 46 and skull 83, and maintain the orifice 81 open so that the stream 56 may flow out of the orifice 81. The orifice may be closed by solidification of the stream 56 of liquid metal 46 if heating power is not applied to the cold finger orifice structure 80. The heating is dependent on each of the fingers of the cold finger orifice structure 80 being insulated from the adjoining fingers, for example being insulated by an air or gas gap or by a suitable insulating material.

The cold finger orifice structure 80 is illustrated in FIG. 4, with both skulls 44 and 83 and the molten metal 46 are omitted for clarity. An individual cold finger 97 is separated from each adjoining finger, such as finger 92, by a gap 94. The gap 94 may be provided and filled with an insulating material, such as, but not limited to, a ceramic material or insulating gas. Thus, the molten metal 46 (not illustrated) that is disposed within the cold finger orifice structure 80 does not leak out through the gaps, because the skull 83 creates a bridge over the cold fingers and prevents passage of liquid metal 46 therethrough. Each gap extends to the bottom of the cold finger orifice structure 80, as illustrated in FIG. 4, which illustrates a gap 99 aligned with a viewer's line-of-sight. The gaps can be provided with a width in a range from about of 20 mils to about 50 mils, which is sufficient to provide an insulated separation of respective adjacent fingers.

The individual fingers may be provided with a coolant, such as water, by passing coolant into a conduit 96 from a suitable coolant source (not shown). The coolant is then passed around and through a manifold 98 to the individual cooling tubes, such as cooling tube 100. Coolant that exits the cooling tube 100 flows between an outside surface of the cooling tube 100 and an inside surface of a finger. The coolant is then collected in a manifold 102, and passed out of the cold finger orifice structure 80 through a water outlet tube 104. This individual cold finger water supply tube arrangement allows for cooling of the cold finger orifice structure 80 as a whole.

The amount of heating or cooling that is provided through the cold finger orifice structure 80 to the skulls 44 and 83, as well as to the liquid metal 46, can be controlled to control the passage of liquid metal 46 through the orifice 81 as a stream 56. The controlled heating or cooling is done by controlling the amount of current and coolant that pass in the induction coils 85 to and through the cold finger orifice structure 80. The controlled heating or cooling can increase or decrease the thickness of the skulls 44 and 83, and to open or close the orifice 81, or to reduce or increase the passage of the stream 56 through the orifice 81. More or less liquid metal 46 can pass through the cold finger orifice structure 80 into the orifice 81 to define the stream 56 by increasing or decreasing the thickness of the skulls 44 and 83. The flow of the stream 56 can be maintained at a desirable balance, by controlling coolant water and heating current and power to and through the induction heating coil 85 to maintain the orifice 81 at a set passage size along with controlling the thickness of the skulls 44 and 83.

The operation of the electroslag refining system 1 of the casting system 3 will now be generally described with reference to the figures. The electroslag refining system 1 can refine ingots that can include defects and impurities or that can be relatively refined. A consumable electrode 24 is melted by the electroslag refining system 1. The consumable electrode 24 is mounted in the electroslag refining system 1 in contact with molten slag in the electroslag refining system. Electrical power is provided to the electroslag refining system and ingot. The power causes melting of the ingot at a surface where it contacts the molten slag and the formation of molten drops of metal. The molten drops to fall through the molten slag. The drops are collected after they pass through the molten slag as a body of refined liquid metal in the cold hearth structure 40 below the electroslag refining structure 30. Oxides, sulfides, contaminants, and other impurities that originate in the consumable electrode 24 are removed as the droplets form on the surface of the ingot and pass through the molten slag. The molten drops are drained from the electroslag refining system 1 at the orifice 81 in the cold finger orifice structure 80 as a stream 56. The stream 56 that exits the electroslag refining system 1 of the casting system 3 that forms castings comprises a refined melt that is essentially free of oxides, sulfides, contaminants, and other impurities.

The rate at which the metal stream 56 exits the cold finger orifice structure 80 can further be controlled by controlling a hydrostatic head of liquid metal 46 above the orifice 81. The liquid metal 46 and slag 44 and 83 that extend above the orifice 81 of the cold finger orifice structure 80 define the hydrostatic head. If a casting system 3 with an electroslag refining system 1 is operated with a given constant hydrostatic head and a constant sized orifice 81, an essentially constant flow rate of liquid metal can be established.

Typically, a steady state of power is desired so the melt rate is generally equal to the removal rate from the casting system 3. However, the current applied to the casting system 3 can be adjusted to provide more or less liquid metal 46 and slag 44 and 83 above the orifice 81. The amount of liquid metal 46 and slag 44 and 83 above the orifice 81 is determined by the power that melts the ingot, and the cooling of the electroslag refining system 1, which create the skulls. By adjusting the applied current, flow through the orifice 81 can be controlled.

Also, the contact of the consumable electrode 24 with an upper surface of the molten slag 34 can be maintained in order to establish a steady state of operation 1. A rate of consumable electrode 24 descent into the melt 46 can be adjusted to ensure that contact of the consumable electrode 24 with the upper surface of the molten slag 34 is maintained for the steady state operation. Thus, a steady-state discharge from the stream 56 can be maintained in the casting system 3. The stream 56 formed in the electroslag refining system 1 of the casting system 3 exits electroslag refining system 1 and is fed to a nucleated casting system 2. The nucleated casting system 2 is schematically illustrated in FIG. 1 in cooperation with the electroslag refining system 1.

The nucleated casting system 2 receives the stream 56 from the electroslag refining system 1 of the casting system 3. The stream 56 can be fed in a controlled atmosphere environment 140 that is sufficient to prevent substantial and undesired oxidation of the metal. The controlled atmosphere environment 140 may include any gas or combination of gases, which do not react with the metal of the stream 56. For example, if the stream 56 comprises aluminum or magnesium, the controlled atmosphere environment 140 presents an environment that prevents the metal from becoming a fire hazard. Typically, any noble gas or nitrogen is suitable for use in the controlled atmosphere environment 140 because these gases are generally non-reactive with most metals and alloys within the scope of the invention. For example, nitrogen, which is a low-cost gas, can be in the controlled atmosphere environment 140, except for metals and alloys that are prone to excessive nitriding. Also, if the metal comprises copper, the controlled atmosphere environment 140 may comprise nitrogen, argon, and mixtures thereof. If the metal comprises nickel or steel, the controlled atmosphere environment 140 can comprise nitrogen or argon, or mixtures thereof.

The stream 56 traverses a cooling zone 144, which is defined by the distance between the bottom of the electroslag refining system 1 and the upper surface 150 of the metal casting 145 that is supported by the mold 146. The cooling zone 144 length is sufficient in length to possibly solidify a volume fraction portion of the stream 56 by the time the stream 56 traverses the cooling zone 144 and impacts the upper surface 150 of the metal casting. The portion of the stream 56 that solidifies (hereinafter referred to as the "solid volume fraction portion") may be sufficient to inhibit coarse dendritic growth in the mold 146 up to a viscosity inflection point at which liquid flow characteristics in the mold are essentially lost.

Further, the mold 146 may comprise a unitary and one-piece mold, as illustrated in the broken lines of FIG. 1. Alternatively, the mold may comprises a withdrawal mold, which includes a retractable base 246 that can be withdrawn from sidewalls of the mold 146. The following description of the invention will discuss a withdrawal mold as an exemplary, non-limiting mold, and is not intended to limit the invention in any manner. The retractable base 246 can be connected to a shaft 241 to move base away from the sidewalls in the direction of arrow 242. Further, the shaft 241 may rotate the retractable base 246 in the direction of arrow 243 to provide surface portions of the liquidus portion 148 to the solid metal particle addition system 200, as described hereinafter.

The stream 56 is supplied to and collected in the mold 146. The liquid stream 56 primarily acts as a liquid if the solid volume fraction portion is less than a viscosity inflection point, and the liquid exhibits sufficient fluidity to conform to the shape of the mold. Generally, an upper solid volume fraction portion limit that defines a viscosity inflection point is less than about 40% by volume. An exemplary solid volume fraction portion is in a range from about 5% to about 40%, and a solid volume fraction portion in a range from about 15% to about 30% by volume does not adversely influence the viscosity inflection point.

The stream 56 creates a turbulent zone within a liquidus portion 148 at the surface 150 of the casting in the mold 146. The liquidus portion 148 can have an approximate depth in the mold 146 in a range from about 0.005 inches to about 1.0 inches. The depth of the liquidus portion 148 is dependent on various casting system 3 factors, including, but not limited to, stream velocity, the cooling zone 144 length, the stream temperature, and droplet size. An exemplary liquidus portion 148 within the scope of invention comprises a depth in a range from about 0.25 to about 0.50 inches in the mold. In general, the liquidus portion 148 in the mold 146 should not be greater than a region of the casting 145, where the metal exhibits predominantly liquid characteristics.

As discussed above, the solid metal particle addition system 200 adds solid metal particles 210 to the surface of the liquidus portion 148 of the casting 145. The solid metal particles 210 can be formed of metal powder, and can serve as nuclei for the solidification of the metal. The solid metal particle addition system 200 comprises a source 201 of solid metal particles 210 that can be added to the casting system 3. Further, the solid metal particle addition system 200 can add the solid metal particles 210 to the liquidus portion 148 of the casting 145 in the controlled atmosphere environment 140. Exemplary non-limiting configurations for the solid metal particle addition system 200 will now be described, with respect to FIGS. 5 and 6. For example, and in no way limiting of the invention, the solid metal particle addition system 200 can be totally within the controlled atmosphere environment 140 or partially within the controlled atmosphere environment 140 so as to transfer solid metal particles 210 from outside the controlled atmosphere environment 140 to inside the controlled atmosphere environment 140. FIGS. 5 and 6 do not illustrate a closed controlled atmosphere environment 140 for ease of illustration.

The solid metal particle addition system 200 adds solid metal particles 210 to the liquidus portion 148 of the casting 145, in which the solid metal particles 210 act as nuclei for the solidification of the liquid metal. The solid metal particles 210 can be formed from any appropriate source 201. The source 201 may be within the controlled atmosphere environment 140 or outside the controlled atmosphere environment 140 and communicate with the interior of the controlled atmosphere environment 140 to allow the solid metal particles 210 to be added to the liquidus portion 148 of the casting 145.

As discussed above, the source 201 may comprise any suitable source that can add solid metal particles 210 to the liquidus portion 148. For example and as illustrated in FIG. 5, the solid metal particle source 201 may comprise an atomizing system 250 (FIG. 5) that produces solid metal particles 210. The atomizing system 250 that is illustrated is exemplary of any atomizing system as known in the art that can produce solid metal particles 210. In FIG. 5, the atomizing system 250 comprises a disruption device 252, which can disperse the solid metal particles to the liquidus portion 148. The disruption device 252 includes at least one gas jet orifice 251. The jet orifice 251 can provide a gas jet to metal provided to the disruption site 252 through the conduit 202 from the source 201. Thus, the atomizing system 250 can produce solid metal particles 210 to be fed to the liquidus portion 148 of the casting 145.

Alternatively, the source 201 can comprise a receptacle-based solid metal particle addition system 260. In the receptacle-based solid metal particle addition system 260, as illustrated in FIG. 6, a receptacle 261 is provided with a supply of solid metal particles 210. The solid metal particles 210 in the receptacle 261 can be provided to the liquidus portion 148 of the casting 145 through conduit 202, so the solid metal particles 210 are distributed over the surface of the liquidus portion 148. The receptacle 261 may have its solid metal particles supply replenished in any appropriate manner. The solid metal particles 210 in the receptacle-based solid metal particle addition system 260 may be dispersed over the surface 150 of the liquidus portion 148 by exiting the conduit 202. Alternatively, the receptacle-based solid metal particle addition system 260 may include dispersion assisting systems to further disperse the solid metal particles 210 over the surface of the liquidus portion 148. For example, and in no way limiting of the invention, the dispersion assisting system may include at least one of vibrating dispersion assisting devices, gas jet dispersion assisting devices, magnetic dispersion assisting devices, shaker dispersion assisting devices, and the like for dispersing the solid metal particles 210 from the conduit over the liquidus portion 148 of the casting 145.

The solid metal particle addition system 200, regardless of the nature of the source 201 of solid metal particles 210, may comprise various configurations to facilitate the dispersion of solid metal particles 210 over the surface of the liquidus portion 148. For example, the source 201 for the solid metal particles may be provided as a rotating source. A rotating source will rotate around the casting system 3, for example in the direction of arrow 270. Thus, the solid metal particles 210 can exit the solid metal particle addition system 200 and be directed and dispersed over a large portion of the liquidus portion 148 of the casting 145. Alternatively, the solid metal particle addition system 200 can be provided with an arcuate configuration 280 to inherently provide dispersion of the solid metal particles as they exit the solid metal particle addition system 200 and are directed to the liquidus portion 148.

Further, the solid metal particle addition system 200 can be provided with a plurality of sources to provide the solid metal particles to the liquidus portion 148. Alternatively, the solid metal particle addition system 200 can be provided with a plurality of conduits 202 that extend to locations around the casting system 3, in which the conduits 202 provide the solid metal particles 210 to the liquidus portion 148 of the casting 145. The conduits can be provided with any dispersion assisting systems for dispersing solid metal particles, as embodied by the invention.

The above-described features for the solid metal particle addition system 200 and the casting system 3 can be used individually. Alternatively, the above-described features for the solid metal particle addition system 200 and the casting system 3 can be used in combination with each other to further enhance the dispersion of solid metal particles 210 to the liquidus portion 148 where the solid metal particles 210 act as nuclei for the solidification of the metal.

Typically, a lower viscosity in liquidus portion 148 when the stream 56 and solid metal particles enter the mold, in which the lower viscosity minimizes gas entrapment and resultant pores in the casting. If the solid volume fraction portion that is solid in the liquidus portion 148 is less than about 50% by volume, gas entrapment in the casting is minimized. For example, if the solid volume fraction portion is in a range from about 5% to about 40% by volume, gas entrapment in the casting is minimized.

The mold 146 extracts heat from the casting by thermal conduction through the mold 146 walls and by convection off of the top surface 150 of the casting. The liquidus portion 148 reduces a thermal gradient of the casting by the inherent turbulent nature in the liquidus portion 148. The reduction of the thermal gradients in conjunction with enhanced nucleation from the addition of the solid metal particles reduces hot tears and dendritic coarsening of the casting, both of which are undesirable in castings.

Heat is extracted from the casting 145 to complete the solidification and form castings. Sufficient nuclei can be formed in the casting 145 so that upon solidification, a fine equiaxed microstructure 149 can be formed in the casting 145 and the resultant article. Porosity and hot working cracking therein are reduced or substantially eliminated by the casting method, as embodied by the invention.

The mold 146 can be formed of any suitable material for casting applications, such as but not limited to, graphite, cast iron, and copper. Graphite is a suitable mold 146 material since it is relatively easy to machine and exhibits satisfactory thermal conductivity for heat removal purposes. Cooling coils that can be embedded in the mold to circulate a coolant may enhance the removal of heat through the mold 146. The scope of the invention comprises other means for cooling the mold, as known in the art. The mold 146 may not need as much thermal protection as in conventional molds, since the semisolid metal may already be partially solidified. Thus, some heat has already been removed from the semisolid metal to partially solidify them and less heat needs to be removed when the semisolid metal is in the mold, compared to conventional castings formed entirely from liquid metals. Decreased heat removal can reduce thermally induced distortion of the mold 146, and this can lead to uniform heat removal rates from the casting to enhance casting uniformity and homogeneity.

Figure 7:
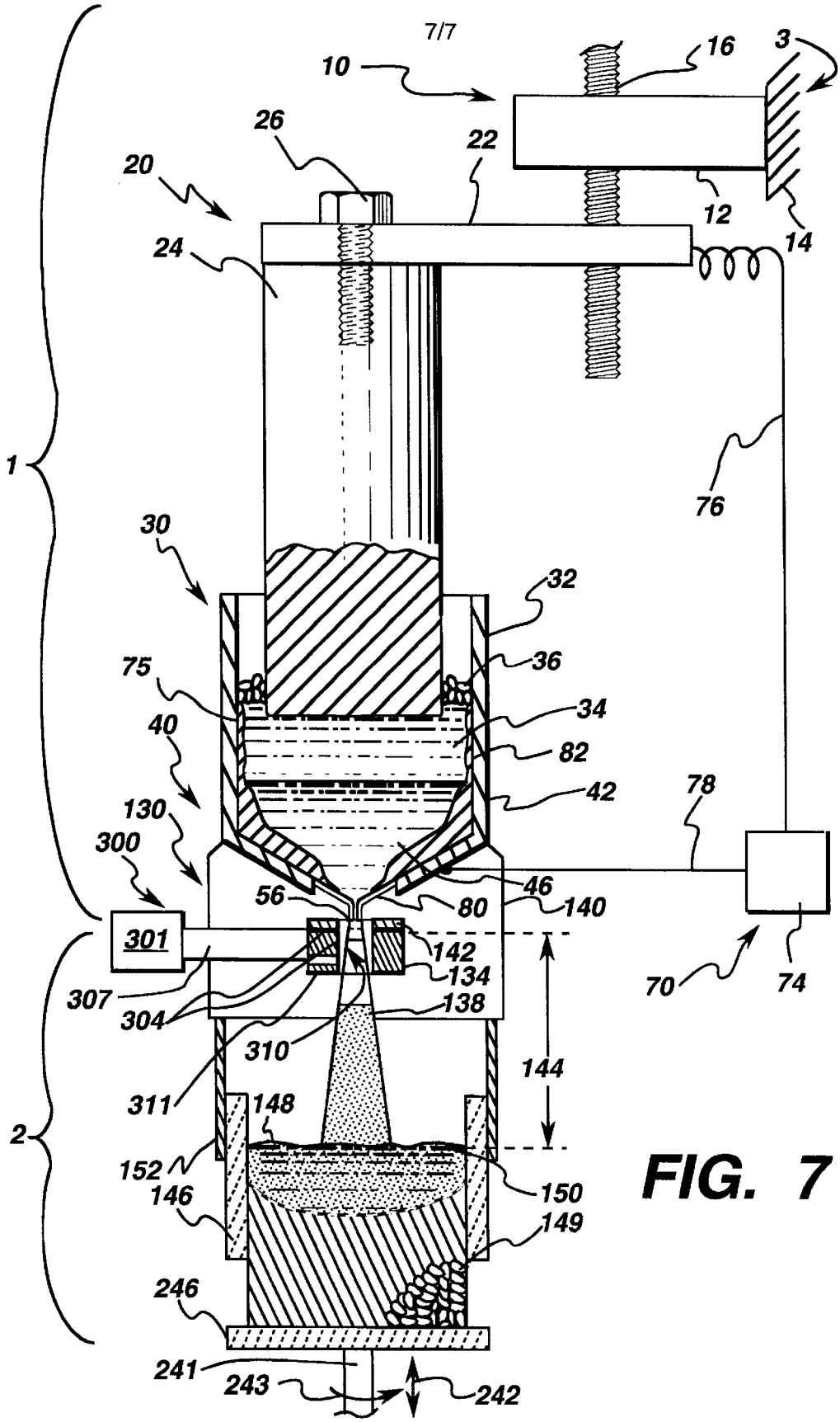
FIG. 7 is a schematic illustration of a further casting system with powder addition, as embodied by the invention.

As the mold 146 is filled with metal, its upper surface 150 moves closer to the disruption site 134 as illustrated in FIG. 7, and the cooling zone 144 is reduced. At least one of the electroslag refining system 1 or the mold 146 may be mounted on a moveable support and separated at a fixed rate to maintain a constant cooling zone 144 dimension. Thus, a generally consistent solid volume fraction portion in the metal is formed. Baffles 152 may be provided in the nucleated casting system 2 to extend the controlled atmosphere environment 140 from the electroslag refining system 1 to the mold 146. The baffles 152 can prevent oxidation of the partially molten metal and conserve the controlled atmosphere environment gas 140.

The casting system 3 inhibits undesirable dendritic growth, reduces solidification shrinkage porosity of the formed casting and casting, and reduces hot tearing both during casting and during subsequent hot working of the casting. Further, the casting system 3 produces a uniform, equiaxed structure in the casting which is a result of the minimal distortion of the mold during casting, the controlled transfer of heat during solidification of the casting in the mold, and controlled nucleation. The casting system 3 enhances ductility and fracture toughness of the casting compared to conventionally castings.

A further casting system with a solid metal particle addition system 300 is illustrated in FIG. 7, in which like features of the invention are provided with like reference numbers as used in the earlier described casting systems. In FIG. 7, powder is added to a spray 138 that is formed by a disruption site 134, as discussed hereinafter. The solid metal particle addition system 300, as illustrated in FIG. 7, comprises a solid metal particle addition system 300 that introduces solid metal particles 310 into a spray 138 at a disruption site 134. The solid metal particle addition system 300 comprises a source 301 of solid metal particles, a conduit 302 that can feed metal from the source 301 to a dispersion system 304 to form solid metal particles. The source 301 of the solid metal particles may comprise any suitable source that can add solid metal particles 310. For example, and in no way limiting of the invention, the solid metal particle source 301 may include an atomizing system that produces solid metal powder, a receptacle comprising solid metal particles that can be by an appropriate device, and other such solid metal particle addition systems. The dispersion system 304 permits the solid metal particles 310 to exit the solid metal particle addition system 300.

The disruption site 134 is positioned to receive the stream 56 from the electroslag refining system 1. The disruption site 134 converts the stream 56 into a plurality of molten metal droplets 138. The stream 56 is fed to disruption site 134 in a controlled atmosphere environment 140 that is sufficient to prevent substantial and undesired oxidation of the droplets 138. The controlled atmosphere environment 140 may include any gas or combination of gases, which do not react with the metal of the stream 56. For example, if the stream 56 comprises aluminum or magnesium, the controlled atmosphere environment 140 presents an environment that prevents the droplets 138 from becoming a fire hazard. Typically, any noble gas or nitrogen is suitable for use in the controlled atmosphere environment 140 because these gases are generally non-reactive with most metals and alloys within the scope of the invention. For example, nitrogen, which is a low-cost gas, can be in the controlled atmosphere environment 140, except for metals and alloys that are prone to excessive nitriding. Also, if the metal comprises copper, the controlled atmosphere environment 140 may comprise nitrogen, argon, and mixtures thereof. If the metal comprises nickel or steel, the controlled atmosphere environment 140 can comprises nitrogen or argon, or mixtures thereof.

The disruption site 134 can comprise any suitable device for converting the stream 56 into droplets 138. For example, the disruption site 134 can comprise a gas atomizer, which circumscribes the stream 56 with one or more jets 142. The flow of gas from the jets 142 that impinge on the stream can be controlled, so the size and velocity of the droplets 138 can be controlled. Another atomizing device, within the scope of the invention, includes a high pressure atomizing gas in the form of a stream of the gas, which is used to form the controlled atmosphere environment 140. The stream of controlled atmosphere environment 140 gas can impinge the metal stream 56 to convert the metal stream 56 into droplets 138. Other exemplary types of stream disruption include magneto-hydrodynamic atomization, in which the stream 56 flows through a narrow gap between two electrodes that are connected to a DC power supply with a magnet perpendicular to the electric field, and mechanical-type stream disruption devices.

The droplets 138 are broadcast downward (FIG. 7) from the disruption site 134 to form a generally diverging cone shape. The droplets 138 traverse a cooling zone 144, which is defined by the distance between the disruption site 134 and the upper surface 150 of the metal casting that is supported by the mold 146. The cooling zone 144 length is sufficient to solidify a volume fraction portion of a droplet by the time the droplet traverses the cooling zone 144 and impacts the upper surface 150 of the metal casting. The portion of the droplet 138 that solidifies (hereinafter referred to as the "solid volume fraction portion") is sufficient to inhibit coarse dendritic growth in the mold 146 up to a viscosity inflection point at which liquid flow characteristics in the mold are essentially lost.

The partially molten/partially solidified metal droplets (referred to hereinafter as "semisolid droplets") collect in mold 146. The semisolid droplets behave like a liquid if the solid volume fraction portion is less than a viscosity inflection point, and the semisolid droplets exhibit sufficient fluidity to conform to the shape of the mold. Generally, an upper solid volume fraction portion limit that defines a viscosity inflection point is less than about 40% by volume. An exemplary solid volume fraction portion is in a range from about 5% to about 40%, and a solid volume fraction portion in a range from about 15% to about 30% by volume does not adversely influence the viscosity inflection point.

The spray of droplets 138 creates a turbulent zone 148 at the surface of the casting in the mold 146. The turbulent zone 148 can have an approximate depth in the mold 146 in a range from about 0.005 inches to about 1.0 inches. The depth of the turbulent zone 148 is dependent on various clean metal nucleated casting system 3 factors, including, but not limited to, the atomization gas velocity, droplet velocity, the cooling zone 144 length, the stream temperature, and droplet size. An exemplary turbulent zone 148 within the scope of invention comprises a depth in a range from about 0.25 to about 0.50 inches in the mold. In general, the turbulent zone 148 in the mold 146 should not be greater that a region of the casting, where the metal exhibits predominantly liquid characteristics.

Typically, a lower viscosity in turbulent zone 148 minimizes gas entrapment and resultant pores in the casting. If the solid volume fraction portion of the average droplet, which is solid in the turbulent zone 148, is less than about 50% by volume, gas entrapment in the casting is minimized. For example, if the solid volume fraction portion of the average droplet, which is solid in the turbulent zone 148, is in a range from about 5% to about 40% by volume, gas entrapment in the casting is minimized.

The solid metal particle addition system 300 can add the solid metal particles with the gas that creates the spray, for example by combining the gas and solid metal particles together in the one or more jets 142. Alternatively, the solid metal particle addition system 300 can add the solid metal particles separate from the gas that creates the spray, for example by a separate passage 311 in which the solid metal particles are added to the spray 138 after the spray has been formed. As another alternative, the solid metal particle addition system 300 can add the solid metal particles both with the gas that creates the spray and in a separate passage.

While various embodiments are described herein, it will be appreciated from the specification that various combinations of elements, variations or improvements therein may be made by those skilled in the art, and are within the scope of the invention.

We claim:

1. A casting system having solid metal particle addition, the casting system forming a casting that comprises a semi-solid portion that receives a stream of a refined liquid metal and a solidified portion, the casting further comprising a fine-grain, homogeneous microstructure that is essentially oxide-free and sulfide-free and is segregation defect free, the casting system comprising:

a source of the refined liquid metal, wherein oxides and sulfides have been refined out of the refined liquid metal, and wherein the source provides the stream of the refined liquid metal to the casting;

a solid metal particle addition system metal that adds solid metal particles to a surface of the semi-solid portion of the casting such that the solid metal particles are dispersed atop the surface of the semi-solid portion, wherein the solid metal particle addition system is separate from the source of refined liquid metal; and a nucleated casting system for forming the casting, wherein the nucleated casting system is adapted to receive both the solid metal particles and the stream of refined liquid metal to form the casting that comprises a fine-grain, homogeneous microstructure that is essentially oxide-free and sulfide-free and is segregation defect free, wherein the solid metal particle addition system adds the solid metal particles that serve as nucleation centers during solidification of the casting.

2. The casting system according to claim 1, wherein the source of refined liquid metal comprises an electroslag refining system.

3. The casting system according to claim 2, wherein the electroslag refining system comprises:

an electroslag refining structure that is adapted for the electroslag refining of the source of refined liquid metal and providing molten slag;

a cold hearth structure for holding a refined molten metal beneath the molten slag and providing refined molten metal in the cold hearth structure;

a source of raw metal for insertion into the electroslag refining structure and into contact with the molten slag in the electroslag refining structure to form the source of refined liquid metal;

an electrical power supply adapted to supply electric power to electroslag refine the source of raw metal through a circuit, the circuit comprising the power supply, the source of raw metal, the molten slag and the electroslag refining structure sufficient for resistance melting the source of raw metal where the source of raw metal contacts the molten slag and forming molten droplets of refined liquid metal;

an outlet for allowing the molten droplets to fall through the molten slag;

a collector for collecting the molten droplets after they pass through the molten slag as a body of refined liquid metal in the cold hearth structure directly below the electroslag refining structure; and a cold finger orifice structure having an orifice at the lower portion of the cold hearth structure for draining the electroslag refined metal that collects in the cold hearth orifice structure through the orifice of the cold finger orifice structure.

4. The casting system according to claim 3, wherein the source of metal comprises an alloy selected from at least one of nickel-, cobalt-, titanium-, or iron-based metals, and the casting formed by the casting process comprises at least one of nickel-, cobalt-, titanium-, or iron-based metals.

5. The casting system according to claim 3, wherein a rate of advance of the source of metal into the refining structure corresponds to the rate at which a lower end of the ingot is melted by the resistance melting.

6. The casting system according to claim 3, wherein the orifice forms a stream of molten metal.

7. The casting system according to claim 3, wherein the electroslag refining structure and the cold hearth structure comprise upper and lower portions of the same structure.

8. The casting system according to claim 3, wherein the electrical power supply comprises a circuit formed in the refined liquid metal.

9. The casting system according to claim 3, wherein the orifice establishes a drainage rate that is approximately equivalent to a rate of resistance melting.

10. The casting system according to claim 1, wherein the nucleated casting system further comprises:

a mold for collecting and solidifying metal from the source, in which a turbulent zone is generated at an upper surface of the mold and, the turbulent zone on average is solidified less than about 50% by volume.

11. The casting system according to claim 10, wherein the turbulent zone on average is solidified about 5% to about 40% by volume.

12. The casting system according to claim 1, wherein the casting comprises at least one of a casting, ingot, and preform.

13. The casting system according to claim 1, wherein the casting comprises at least one of nickel-, cobalt-, titanium-, or iron-based metals.

14. The casting system according to claim 1, wherein the casting is capable for use in turbine component applications.

15. The casting system according to claim 1, wherein the source of refined liquid metal is selected from at least one of a consumable electrode, a powdered source of metal, and melt source of metal.

16. The casting system according to claim 1, wherein the solid metal particle addition system comprises:

at least one source of solid metal particles and at least one dispersion system that permits solid metal particles to exit the solid metal particle addition system and be fed to the casting.

17. The casting system according to claim 1 further comprising a controlled atmosphere environment, wherein the solid metal particle addition system being within the controlled atmosphere environment.

18. The casting system according to claim 1 further comprising a controlled atmosphere environment, wherein the solid metal particle addition system is partially within the controlled atmosphere environment.

19. The casting system according to claim 17, wherein the solid metal particle addition system comprises a source of solid metal particles, the source of solid metal particles is partially within the controlled atmosphere environment.

20. The casting system according to claim 18, wherein the solid metal particle addition system comprises a source of solid metal particles, the source of solid metal particles is partially within the controlled atmosphere environment.

21. The casting system according to claim 20, wherein the source of solid metal particles comprises an atomization system that forms solid metal particles from liquefied metal, in which the solid metal particles are fed to the casting from the atomization system.

22. The casting system according to claim 20, wherein the source of solid metal particles comprises a receptacle having solid metal particles therein, in which the solid metal particles are fed to the casting from the receptacle.

23. The casting system according to claim 20, wherein the source of solid metal particles comprises a rotating source of solid metal particles for feeding solid metal particles to the casting.

24. The casting system according to claim 20, wherein the source of solid metal particles comprises an arcuate configuration for feeding solid metal particles to the casting.

25. The casting system according to claim 1, wherein the solid metal particle addition system comprises at least one dispersion assisting system that facilitates addition of the solid metal particles to the semi-solid portion of the casting.

26. The casting system according to claim 25, wherein the dispersion assisting system is selected from at least one of:

a vibrating dispersion assisting device, a gas jet dispersion assisting device, a magnetic dispersion assisting device, a shaker dispersion assisting device, and combinations thereof.

27. A casting method with solid metal particle addition provided to a casting that is formed by the casting method, the casting comprising a semi-solid portion that receives a stream of a refined liquid metal and a solidified portion, the casting further comprising a fine-grain, homogeneous microstructure that is essentially oxide-free and sulfide-free and is segregation defect free, the casting method comprising:

providing a source of the refined liquid metal, the refined liquid metal having oxides and sulfides refined out of the metal;

supplying the source of refined liquid metal to a nucleated casting system;

forming a casting by nucleated casting in the nucleated casting system, the casting comprising a semi-solid portion and a solidified portion; and adding solid metal particles to an exposed surface of the semi-solid portion;

wherein solid metal particles serve as nucleation centers during solidification.

28. The method according to claim 27, wherein the step of providing a source of refined liquid metal comprises electroslag refining, the step of electroslag refining comprises:

providing a source of the refined liquid metal to be refined;

providing an electroslag refining structure adapted for the electroslag refining of the source of refined liquid metal and providing molten slag in the vessel;

providing a cold hearth structure for holding a refined molten metal beneath the molten slag and providing refined molten metal in the cold hearth structure;

mounting the source of refined liquid metal for insertion into the electroslag refining structure and into contact with the molten slag in the electroslag refining structure;

providing an electrical power supply adapted to supply electric power;

supplying electric power to electroslag refine the source of refined liquid metal to form refined liquid metal in the form of molten droplets through a circuit, the circuit comprising the power supply, the source of metal, the molten slag and the electroslag refining structure;

resistance melting of the source of metal where the source of metal contacts the molten slag and forming molten droplets of metal;

allowing the molten droplets to fall through the molten slag;

collecting the molten droplets after they pass through the molten slag as a body of refined liquid metal in the cold hearth structure directly below the electroslag refining structure;

providing a cold finger orifice structure having a orifice at the lower portion of the cold hearth structure; and draining the electroslag refined metal that collects in the cold hearth orifice structure through the orifice of the cold finger orifice structure.

29. The method according to claim 28, wherein the source of refined liquid metal comprises an alloy selected from at least one of nickel-, cobalt-, titanium-, or iron-based metals, and the casting formed by the nucleated casting method comprises at least one of nickel-, cobalt-, titanium-, or iron-based metals.

30. The method according to claim 28, wherein a rate of advance of the source of refined liquid metal into the refining structure corresponds to the rate at which of resistance melting.

31. The method according to claim 28, wherein the step of draining comprises forming a stream of molten metal.

32. The method according to claim 28, wherein the electroslag refining structure and the cold hearth structure comprise upper and lower portions of the same structure.

33. The method according to claim 28, wherein the step of supplying electric power comprises forming a circuit in the refined liquid metal.

34. The method according to claim 28, wherein the step of draining comprises establishing a drainage rate that is approximately equivalent to a rate of resistance melting.

35. The method according to claim 28, wherein the step of forming a casting further comprises:

forming a stream of refined liquid metal; and collecting and solidifying the stream in a mold for forming the casting by the step of nucleated casting, in which a turbulent zone is generated by the stream at an upper surface thereof and, wherein the step of collecting and solidifying, on average solidifies less than about 50% by volume of the stream.

36. The method to claim 27, wherein the step of adding solid metal particles to a surface of the semi-solid portion comprises:

adding solid metal particles from a source and dispersing the solid metal particles with a dispersion system that permits solid metal particles to be fed to the casting.

37. The method according to claim 27, wherein the step of adding solid metal particles to a surface of the semi-solid portion comprises adding the solid metal particles in a controlled atmosphere environment.

38. The method according to claim 27, wherein the step of adding solid metal particles to a surface of the semi-solid portion comprises forming solid metal particles from liquefied metal in an atomization system.

39. The method according to claim 27, wherein the step of adding solid metal particles to a surface of the semi-solid portion comprises feeding solid metal particles from a receptacle to the casting.

40. The method according to claim 27, wherein the step of adding solid metal particles to a surface of the semi-solid portion comprises rotating a source of solid metal particles to add the solid metal particles over a surface of the semi-solid portion of the casting.

41. The method according to claim 27, wherein the step of adding solid metal particles to a surface of the semi-solid portion comprises dispersing the solid metal particles to the semi-solid portion of the casting.

42. The method according to claim 41, wherein the step of adding solid metal particles to a surface of the semi-solid portion further assisting the dispersion of solid metal particles to the semi-solid portion by at least one of:

vibrating, dispersing with a gas jet, dispersing with a magnet, shaking, and combinations thereof.

43. A casting method comprising:

electroslag refining a metal electrode to produce a refined molten stream;

cooling said stream to establish a solid volume fraction portion thereof up to a viscosity inflection point;

collecting said stream in a mold to form a liquid metal pool therein;

dispersing solid metal particles atop an exposed surface of said pool to provide nuclei therein;

extracting heat from said mold to solidify said pool in a solidified portion of said casting having a semi-solid portion thereatop; and solidifying said pool at said nuclei to form a solidified casting therein.

44. A method according to claim 43 wherein said particles comprise metal powder.

45. A method according to claim 43 further comprising atomizing a liquified metal to form said particles.

46. A method according to claim 43 further comprising rotating distribution of said particles for dispersion thereof over said semi-solid surface.

47. A method according to claim 43 wherein said particles are dispersed over said semi-solid surface from a plurality of sources.

48. A method according to claim 43 further comprising retracting said casting from said mold as said mold fills with metal solidified from said semi-solid portion.

49. A method according to claim 48 further comprising rotating said casting for rotating said semi-solid portion and dispersing said particles thereatop.

* * * * *